US012410799B2

(12) United States Patent
Rowe et al.

(10) Patent No.: US 12,410,799 B2
(45) Date of Patent: Sep. 9, 2025

(54) SECONDARY AIRFLOW PATHS FOR AIR COMPRESSORS

(71) Applicant: Doosan Bobcat North America, Inc., West Fargo, ND (US)

(72) Inventors: David Rowe, Clemmons, NC (US); Tuan Diep, Charlotte, NC (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 0 days.

(21) Appl. No.: 18/627,207

(22) Filed: Apr. 4, 2024

(65) Prior Publication Data

US 2024/0337262 A1 Oct. 10, 2024

Related U.S. Application Data

(60) Provisional application No. 63/494,321, filed on Apr. 5, 2023.

(51) Int. Cl.

| | |
|---|---|
| ***F04C 18/08*** | (2006.01) |
| ***F02C 3/32*** | (2006.01) |
| ***F04B 11/00*** | (2006.01) |
| ***F04B 41/06*** | (2006.01) |
| ***F04C 18/107*** | (2006.01) |
| ***F04C 23/00*** | (2006.01) |
| ***F04C 23/02*** | (2006.01) |
| ***F04C 29/00*** | (2006.01) |
| ***F04C 29/02*** | (2006.01) |
| ***F04C 29/04*** | (2006.01) |
| ***F04C 29/12*** | (2006.01) |

(52) U.S. Cl.

CPC ..... *F04C 29/12* (2013.01); *F04C 18/082* (2013.01); *F04C 18/084* (2013.01); *F04C 18/107* (2013.01); *F04C 23/02* (2013.01); *F04C 29/026* (2013.01)

(58) Field of Classification Search

CPC ..... F04C 29/12; F04C 29/042; F04C 18/107; F04C 18/082; F04C 18/084; F04C 23/02; F04C 23/001; F04C 23/003; F04C 23/005; F04C 23/006; F04C 29/122; F02C 3/32; F04B 11/00; F04B 41/06

See application file for complete search history.

(56) References Cited

U.S. PATENT DOCUMENTS

| | | | | |
|---|---|---|---|---|
| 7,165,949 | B2 * | 1/2007 | Firnhaber | F04C 29/122 417/310 |
| 2004/0060717 | A1 | 4/2004 | Leppanen | |
| 2009/0297340 | A1 * | 12/2009 | Schwartz | F04C 18/3446 415/160 |

FOREIGN PATENT DOCUMENTS

| | | | | |
|---|---|---|---|---|
| CN | 110678654 | A * | 1/2020 | F04C 18/16 |
| EP | 1798416 | B1 | 4/2009 | |
| EP | 2545280 | B1 | 2/2020 | |

OTHER PUBLICATIONS

English CN 110678654 by PE2E Aug. 19, 2024.*

International Searching Authority, International Search Report and Written Opinion issued for corresponding International Application No. PCT/US2024/023142 mailed Nov. 4, 2024 [12 pgs].

* cited by examiner

*Primary Examiner* — Deming Wan

(74) *Attorney, Agent, or Firm* — Quarles & Brady LLP

(57) ABSTRACT

A secondary airflow path can be provided for a compressor of a compressor system. The secondary airflow path can provide pressurized air to a boost port in communication with a closed compression cell of the compressor.

16 Claims, 7 Drawing Sheets

SECONDARY AIRFLOW PATHS FOR AIR COMPRESSORS

CROSS-REFERENCE TO RELATED APPLICATIONS

This application claims priority to and incorporates by reference U.S. provisional patent application No. 63/494,321, filed Apr. 5, 2023.

BACKGROUND

The present disclosure relates to rotating machines. More particularly, the disclosure relates to compressor systems (e.g. air compression systems) that are operatively powered by a power source (e.g., an internal combustion engine) to provide pressurized fluid flow (e.g., pressurized air).

The discussion above is merely provided for general background information and is not intended to be used as an aid in determining the scope of the claimed subject matter.

SUMMARY

Embodiments of the invention, as generally disclosed herein, can relate to rotary screw compressors, and in particular to systems and methods for providing a secondary airflow into a trapped volume of air, known as a compression cell, between meshed rotors. An additional compressor can be configured, for example, to provide pressurized air to closed compression cells, and can be operated accordingly (e.g., by a controller based on one or more operational parameters of the compressor system to selectively provide increased supply of service air). In some cases, a port to connect a secondary airflow path to compression cells can be positioned at particular distances downstream of the closing of relevant compression cells, to provide additional air for compression within the cells with minimal additional input power demand.

According to some aspects of the disclosure, an air compression system is provided. The air compression system can include a separator tank, a service air outlet that is in fluid communication with the separator tank to supply compressed service air for work operations, and a compressor in fluid communication with the separator tank. The compressor can include a first rotor, a second rotor meshed with the first rotor and a housing structure that defines an air inlet, an air outlet, and a compression chamber that encloses the first and second rotors. The compression chamber can include a radial cut-off arranged to successively close compression cells formed by the first and second rotors, during rotation of the first and second rotors, for compression of air within the compression cells and delivery of the compressed air from the compression cells to the air outlet. A boost port can be in fluid communication with the compression chamber to direct pressurized air into the compression cells downstream of the radial cut-off.

In some examples, the compressor can be a first compressor. The air compression system can include a second compressor arranged to provide the pressurized air to the boost port. In some examples, the second compressor can be an electrically powered compressor. In some examples, the second compressor can be a booster or a turbo-charger of an engine arranged to power the compressor.

In some examples, the air compression system can include a pressure reservoir arranged to provide the pressurized air to the boost port. In some examples, the pressure reservoir can be formed by a gear case of the compressor. In some examples, the pressure reservoir can be arranged to be pressurized by the compressed air from the air outlet.

In some examples, the boost port can be at an outlet of an oil passageway in communication with a gearbox of the compressor. In some examples, the air compression system can include a boost line that intersects the oil passageway to provide the pressurized air.

In some examples, the air inlet can be open to atmospheric pressure.

In some examples, the boost port can be at an upstream end of the compression chamber.

In some examples, the boost port can be a first boost port. The air compression system can include a second boost port in fluid communication with the compression chamber to direct the pressurized air into the compression cells downstream of the radial cut-off. In some examples, the second boost port can be arranged downstream of the first boost port along the compression chamber.

According to some aspects of the disclosure, a method of operating an air compression system is provided. The method can include powering a compressor to receive air at an air inlet of a housing structure of the compressor. Powering the compressor can include powering rotation of a first rotor and a second rotor meshed with the first rotor within a compression chamber to successively close compression cells formed by the first and second rotors, for compression of air within the compression cells and delivery of the compressed air via the air outlet for work operations. The method can further include pressurizing boost air and providing the pressurized boost air to a boost port in fluid communication with the compression chamber downstream of the radial cut-off of the compression chamber.

In some examples, the compressor can be a first compressor. The boost air can be pressurized by a second compressor separate from the first compressor.

In some examples, pressurizing the boost air can include pressurizing the boost air within a storage reservoir. Providing the pressurized boost air to the boost port can include providing the pressurized boost air from the storage reservoir.

In some examples, the method of operating the air compression system can include identifying, using one or more control devices, an increased demand for service air during operation of the compressor to supply the compressed service air. Providing the pressurized boost air to the boost port can include opening a flow path for flow of the pressurized boost air to the boost port in response to identifying the increased demand for the service air.

According to some aspects of the disclosure, an air compression system can include an oil-flooded rotary screw compressor. The oil-flooded rotary screw compressor can include a first rotor, a second rotor meshed with the first rotor and a housing structure. The housing structure can define an air inlet, an air outlet, and a compression chamber that encloses the first and second rotors. The compression chamber can include a radial cut-off arranged to successively close compression cells formed by the first and second rotors, during rotation of the first and second rotors, for compression of air within the compression cells and delivery of the compressed air from the compression cells to the air outlet. A boost port can be in fluid communication with the compression chamber to direct pressurized air into the compression cells downstream of the radial cut-off.

In some examples, a boost compressor can be arranged to provide the pressurized air to the boost port. In some examples, the boost compressor can be secured to the housing structure. In some examples, the boost compressor can be one or more of: an electrically powered compressor, a booster of an engine arranged to power the oil-flooded rotary screw compressor, or a turbo-charger of the engine.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
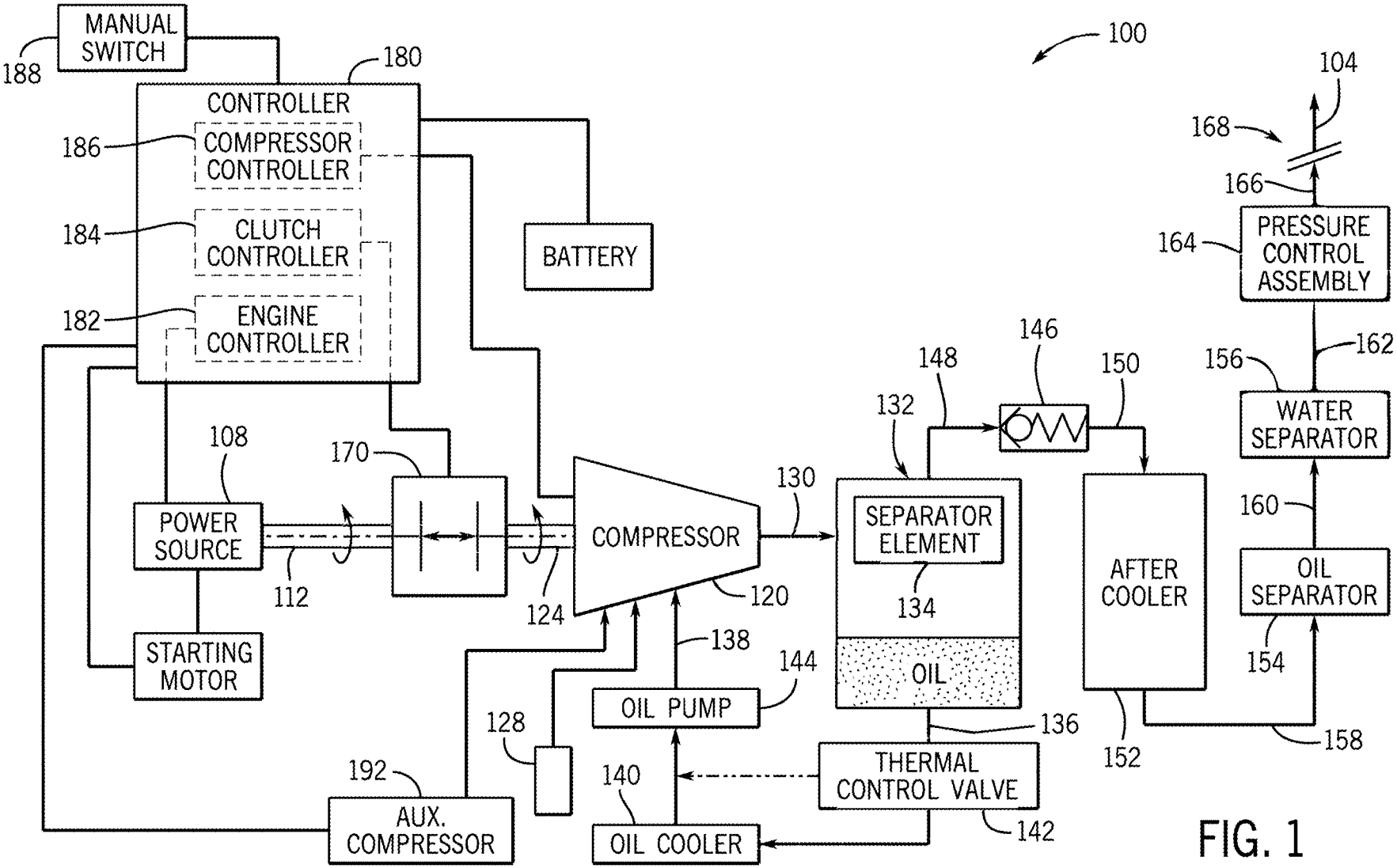
FIG. 1 is a schematic view of a compressor system having a power source coupled to a compressor, according to aspects of the disclosure.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items As used herein with respect to a compression of gas, unless otherwise specified or limited, "upstream" and "downstream" correspond to areas of higher and lower pressure, respectively, or to directions of decreasing or increasing pressure gradient, respectively, along the compression process. For example, for compression of air by a rotary screw air compressor with rotors configured to rotate along parallel axes, an upstream direction can extend in parallel with the rotor axes toward a lower pressure position of the rotors (i.e., toward where the compression cells are initially closed) and a downstream direction can extend in parallel with the rotor axes toward a higher pressure position of the rotors (i.e., toward where the compression cells align with a discharge port or otherwise release the compressed air). Correspondingly, a location that is more upstream along such a compression process, relative to a reference location, is a location that has a lower pressure than the reference location. For example, upstream and downstream positions within a compression chamber (or sub-chamber) between rotors are, respectively, lower and higher pressure positions within the chamber (or sub-chamber), respectively.

Also as used herein, unless otherwise specified or limited, "speed" refers to a rotational speed of a rotating body, as can be measured in revolutions per minute (RPM). In particular, a "speed" of an engine refers to the rotational speed of a drive shaft of the engine, as in some cases may also equal the rotational speed of one or more output shafts of the engine.

Conventional rotary screw air compressors compress air by continuously trapping volumes of air in compression cells that are defined between meshed rotors of the compressors and a surrounding housing. With continuous rotation of the rotors, the housing successively seals off each compression cell, which traps a volume of air in the compression cell. Through further rotation of the rotors, the volume of air within the compression cell is then progressively reduced, resulting in further compression of air in the compression cell and a corresponding increase in air pressure. The compressed air can then, for example, be delivered to a separator tank via a discharge port, and then further conditioned, as needed, before being supplied for work operations at a service air outlet.

Generally, compressors use ambient air pressure to provide airflow into a compressor inlet. However, using ambient air pressure to provide the flow of air into a compressor can result in relatively low intake air density, corresponding to reduced capacity of the compressor to deliver service air. This issue may be particularly acute, for example, during use of the compressor in high altitudes (i.e., with correspondingly lower density of ambient intake air). As another example, the air compression process can itself heat incoming air, with corresponding reductions in intake air density at the compression cells. Further, aerodynamic restrictions in the compressor inlet can also reduce intake air density even beyond ambient conditions, including due to air filtration, air piping, and aspects of air inlet geometry.

Some designs can provide pressurized air rather than ambient air at a compressor air inlet. For example, some compressor systems include a turbocharger powered by a power source (e.g., an internal combustion engine) that compresses air for delivery to a main air inlet. This approach can provide increased intake air density and corresponding improvements in compressor throughput. However, it can also require that the entire mass flow of the air into the compressor is pre-compressed, which can require larger and more costly components for the pre-compression process than approaches discussed herein.

To provide more efficient compressor systems, some embodiments of the disclosed technology can selectively increase density of air within a compressor through a secondary airflow path to the compression cells (e.g., in parallel with an airflow path to a main air inlet). Correspondingly, embodiments of this disclosure provide systems and methods for providing pressurized air flow along a secondary airflow path to a closed compression cell, for further compression by a compressor. In particular, a boost port can be provided in a compression chamber (e.g., as formed in a housing structure thereof) to inject pressurized air into a compression cell downstream of a corresponding radial cut-off structure. In general, this approach can provide for improved throughput for a given compressor, with relatively little additional energy expenditure. Further, smaller components can be used, because the additional air can be provided through the boost port rather than via the entire air flow through the compressor inlet.

Some embodiments in particular can provide particular pathways and positioning for secondary airflow paths. For example, a boost port to deliver a secondary airflow into a closed compression cell can be aligned at particular locations in a compression chamber, or particular pressure sources can be utilized. Some embodiments of the disclosed technology can provide additional pressurized air to compression cells when the compression cells are first formed. Some embodiments of the disclosed technology can provide multiple secondary airflow paths to further increase air pressure and flow delivered by the compressor.

Some embodiments can provide a secondary compressor to provide pressurized air for a secondary airflow path to compression cells. In some cases, a secondary compressor can be configured as an electrically powered compressor. In some cases, a secondary compressor can be a booster or a turbo-charger of an engine that powers the compressor. In some cases, a pressure reservoir can be arranged to provide the pressurized air to a secondary airflow path.

The concepts described herein can be practiced on a variety of different types of machinery. Representative rotating machines on which aspects of the disclosure can be practiced are illustrated in FIG. 1. The compressor system of FIG. 1 is described herein to provide a reference for understanding environments on which the embodiments described below related to compressor control systems and methods may be practiced. Thus the discussion below should not be considered limiting especially as to the description of features that are not essential to the disclosed technology and thus may or may not be included in some embodiments of the invention disclosed herein. Unless specifically noted otherwise, embodiments disclosed below can be practiced on a variety of rotating machines, with the compressor system of FIG. 1 being only one example of those rotating machines. For the sake of brevity, only one specific example of rotating machines is illustrated and discussed as being a representative compressor system. However, as mentioned above, the embodiments described below can be practiced on any of a number of rotating machines, including air compressors, pumps, and the like.

FIG. 1 is a schematic illustration of the representative rotating machine configured as a compressor system 100, which can be configured to generate and discharge an air flow or another compressed gas (e.g., a refrigerant). The compressor system 100 generally includes a power source that is configured to provide power (e.g., rotational power) to a driven component. In the illustrated embodiment, the compressor system 100 is configured as an air compression system (e.g., a single-stage air compression system) that is configured to take in and pressurize atmospheric air to provide a pressurized air flow to a job site, via a supply line 104 (e.g., a service line). In other embodiments, a compressor system can be a multi-stage compressor system. In some cases, the compressor system 100 can be configured as a portable compressor system that can be moved between various job sites, or as a stationary (e.g., permanent) compressor system.

A compressor system can be configured to generate a pressurized air flow. For example, to compress atmospheric air and provide an air flow at the supply line 104, the compressor system 100 includes a power source configured as an engine 108 (e.g., a diesel engine or another type of internal combustion engine), although other types of power sources can also be used. The engine 108 includes and is configured to rotate an output shaft 112, for example, a crankshaft or flywheel. The output shaft 112 can be configured to provide (rotational) power to a driven device, namely, a compressor 120 (e.g., dry or oil-flooded compressor) that is configured to pressurize air and discharge an air flow. More specifically, the output shaft 112 can be coupled to an input shaft 124 of the compressor 120. Accordingly, the engine 108 can be operatively coupled to the compressor 120 so that the engine 108 powers the compressor 120. There are many different types of power-source driven compressors applicable to this disclosure. For example, the compressor 120 can be configured as a dry screw compressor, a reciprocating compressor, a centrifugal compressor, or an oil-flooded screw compressor.

With continued reference to FIG. 1, the compressor 120 can be configured as an oil-flooded screw compressor, in which oil flows around and between two counter-rotating screws to cool, lubricate, and improve sealing between components as the changing size of cells between the screws compresses the air. For example, atmospheric air can be drawn into the compressor 120 at an air inlet valve 128, to be compressed by the rotation of the screws, and then discharged from the compressor 120 as a high-pressure flow at a compressor outlet 130.

During operation of the compressor 120, some of the oil may mix with the air and be carried through the compressor outlet 130. However, it can be undesirable to provide operators with an air flow that contains oil. Accordingly, for example, compressed air from the compressor 120 can pass through the compressor outlet 130 to a separator tank 132 configured to separate oil from the pressurized air with a separator element 134 (e.g., a filter or other mechanical separation element with structures to guide fluid flow or otherwise capture entrained oil droplets). Oil that is removed from the air by the separator element 134 can be drained (e.g., to an oil sump) at the bottom of the separator tank 132, while the pressurized air remains above the oil in the separator tank 132 to be provided for service on demand.

In some cases, oil that is removed from the air-oil mixture in the separator tank 132, can then be re-used to lubricate the compressor 120. In particular, the separator tank 132 can include an oil outlet 136 that allows oil from the oil sump to flow back into the compressor 120 via an oil inlet 138. In some cases, an oil cooler 140 can be disposed between the separator tank 132 and the compressor 120 to provide a cooled oil flow to the compressor 120 (e.g., in combination with a thermal control valve 142 and an oil pump 144, as shown). This can help to cool the compressor 120 and other components of the compressor system 100 by removing at least some of the heat generated by compression of air within the compressor 120. In some cases, the pressure of the air within the separator tank 132 can drive the oil flow along the return path to the compressor 120.

In some embodiments, a separator tank can also serve as a storage tank that can store pressurized air from a compressor for use when needed at a supply line. In this regard, the separator tank 132 can serve as a buffer that stores a pressurized volume of air and thereby allows the compressor system 100 to provide air flow at flow rates that are greater than those that can be provided by the compressor 120 alone. Thus, in some cases, the air within the separator tank 132 may be held at a pressure that is higher than a pressure supplied at the supply line 104.

To maintain pressure within the separator tank 132, the compressor system 100 can include a minimum pressure valve 146 that is coupled to an air outlet 148 of the separator tank 132. For example, the minimum pressure valve 146 can be configured as a normally closed, spring biased check valve that only opens when the pressure of the air passing through the air outlet 148 is large enough to overcome the force of the spring or other biasing element. In some cases, the minimum pressure valve 146 can be an adjustable pressure valve. In some cases, the minimum pressure valve 146 can be configured as a sonic orifice. Additionally, the minimum pressure valve 146 can also inhibit or prevent air or other material from reversing its flow direction and entering the separator tank 132, oil cooler 140, and compressor 120 from the downstream (e.g., the supply line 104) side of the system. In other embodiments, the minimum pressure valve 146 can be provided along other points on the flow path between the separator tank 132 and the supply line 104.

In some cases, a compressor system can include additional components disposed between the compressor and a supply line to remove additional contaminants (e.g., water and oil) from the air flow. For example, as illustrated in FIG. 1, the compressor system 100 includes an aftercooler 152 that is coupled with an outlet 150 of the minimum pressure valve 146. The aftercooler 152 is a heat exchanger that cools the air to remove heat produced during compression. Consequently, as the air cools within the aftercooler 152, the air approaches its dew point, which causes moisture to condense out of the air. Additionally, the compressor system 100 can also include an oil separator 154 (e.g., a filter) and a water separator 156 to further remove oil and water from the service air flow. As illustrated in FIG. 1, service air can flow from an outlet 158 of the aftercooler 152 to the oil separator 154 and then from an outlet 160 of the oil separator 154 to the water separator 156. In other embodiments, the aftercooler 152, the oil separator 154, and the water separator 156 can be arranged differently, or in other combinations.

Prior to exiting the compressor system 100 at the supply line 104, the air can pass from an outlet 162 of the water separator 156 and through a pressure control assembly 164. The pressure control assembly 164 can be configured to control a pressure of the air flow that is provided to the supply line 104 (e.g., a supply pressure of the compressor system 100) at a connection point 166 (e.g., a hose connector or other structure). Accordingly, pressurized air from the compressor system 100 can pass from the compressor 120 to the supply line 104, via an outlet 168 of the pressure control assembly 164, when the supply line 104 is coupled to the connection point 166. The pressure control assembly 164 may be an adjustable pressure control assembly that can be manipulated by a user to supply a desired air pressure at the supply line 104.

In some embodiments, the compressor system 100 can include a coupling device configured as a clutch 170 that is disposed mechanically between the engine 108 and the compressor 120. In particular, the clutch 170 is coupled to both the engine 108 (e.g., at the output shaft 112) and the compressor 120 (e.g., at the input shaft 124) and is configured to move between a disengaged configuration and an engaged configuration. In the disengaged configuration, the output shaft 112 and the input shaft 124 are decoupled from one another so that the engine 108 does not power the compressor 120 (e.g., torque is not transferred between the output shaft 112 and the input shaft 124). Accordingly, the output shaft 112 and the input shaft 124, and the shafts 112, 124 can rotate independently of one another. The clutch 170 can be any of a number of coupling devices that are configured to selectively couple two rotating bodies together. For example, the clutch 170 can be configured as an electromagnetic friction clutch having a drive member that is configured to selectively couple with and power rotation of a driven member. In other embodiments, however, other clutch configurations can be used. For example, a clutch can be configured as a radial clutch, wherein a drive member or a driven member move along a radial direction relative to one another to move between the disengaged configuration and the engaged configuration.

Continuing, the compressor system 100 can further include a controller 180 that can be configured to control one or more operational parameters of the compressor system (e.g., an electronic control device or system of various generally known configurations). For example, the controller 180 of the compressor system 100 can be configured to control a rotational speed of the output shaft 112 (e.g., via electronic control of a speed of the engine 108), the engagement and disengagement of the engine 108 with the compressor 120 (e.g., via electronic control of the clutch 170), or the opening and closing of the air inlet 128 of the compressor 120 (e.g., via control of an on-off or proportional valve), among other aspects including monitoring of operational parameters and controlling an active/inactive state of the compressor, as will be described. In some examples, the controller 180 can control operation of a secondary (e.g., second or boost) compressor or otherwise control delivery of boost pressure from a pressure source (e.g., via control of one or more valves), including for operation of systems as further described below.

The controller 180 can be implemented as one or more known types of processor devices (e.g., microcontrollers, field-programmable gate arrays, programmable logic controllers, logic gates, etc.), including as part of general or special purpose computers. In addition, the controller 180 can also include other generally known computing components, including memory, inputs, output devices, etc. (not shown), as appropriate. In this regard, the controller 180 can be configured to implement some or all of the operations of the control processes described herein, which can, as appropriate, be executed based on instructions or other data retrieved from memory. In some embodiments, the controller 180 can include multiple control devices (or modules) that can be integrated into a single component or arranged as multiple separate components. In some embodiments, the controller 180 can be part of a larger control system and can, accordingly, include or be in electronic communication with a variety of control modules, for example, engine controllers, clutch controllers, compressor controllers, hub controllers, etc. For example, as illustrated in FIG. 1, the controller 180 may include one or more of a dedicated engine controller 182, a dedicated clutch controller 184 a dedicated compressor controller 186, or various other control modules.

Generally, the controller 180 can be configured to control the compressor system 100 in response to a user input, or in response to or otherwise based on one or more operational parameters of the compressor system (e.g., as sensed by various sensors on or around a compressor system, or predetermined and stored in memory). For example, the compressor system 100 can include user interfaces such as control panels, displays (including touchscreen displays), switches, buttons, and control levers, among others. In the illustrated embodiment, the compressor system 100 can include a manual switch 188 for manually transitioning the compressor system into or out of an economy mode, and the controller 180 can monitor the position or state of the manual switch 188, as will be described. Correspondingly, as also discussed above, the controller 180 can operate to monitor or control a speed of the engine 108 or to monitor or control the state of the air inlet valve 128.

The controller 180 can also be configured to monitor one or more operational parameters of the compressor system. For example, the controller 180 can be configured to increase an engine speed to maintain a supply pressure at the supply line 104. Conversely, the controller 180 can reduce an engine speed when a lower air flow is needed to maintain a supply pressure at the supply line 104, such as when no air is flowing from supply line, but the separator tank 132 is not at an operational pressure (e.g., the compressor system 100 is filling the separator tank 132). For example, the engine 108 may be at a first engine speed that is between 1,000 RPM and 1,600 RPM, or more particularly, approximately 1,200 to 1,400 RPM, which may correspond with a high-idle speed of the engine 108 for maintaining an operational pressure within the tank 132. The engine 108 may receive a first engine speed signal from the controller 180 (e.g., the engine controller 182) to reduce the engine speed to a lower, second engine speed that is, for example, between 500 RPM and 1,000 RPM, thereby reducing the compressor output to reduce the pressure in the tank 132.

Additionally, the controller 180 can monitor and control the air inlet 128. For example, the air inlet 128 of the compressor 120 can be closed or opened (or in any position between closed and open) based on the output demand on the compressor system 100. For example, the controller 180 (e.g., a compressor controller 186) can be configured to send an inlet position signal (e.g., an open signal or a closed signal) to an electronic inlet valve on the air inlet 128 of the compressor 120 based on one or more (operational) parameters.

Figure 2:
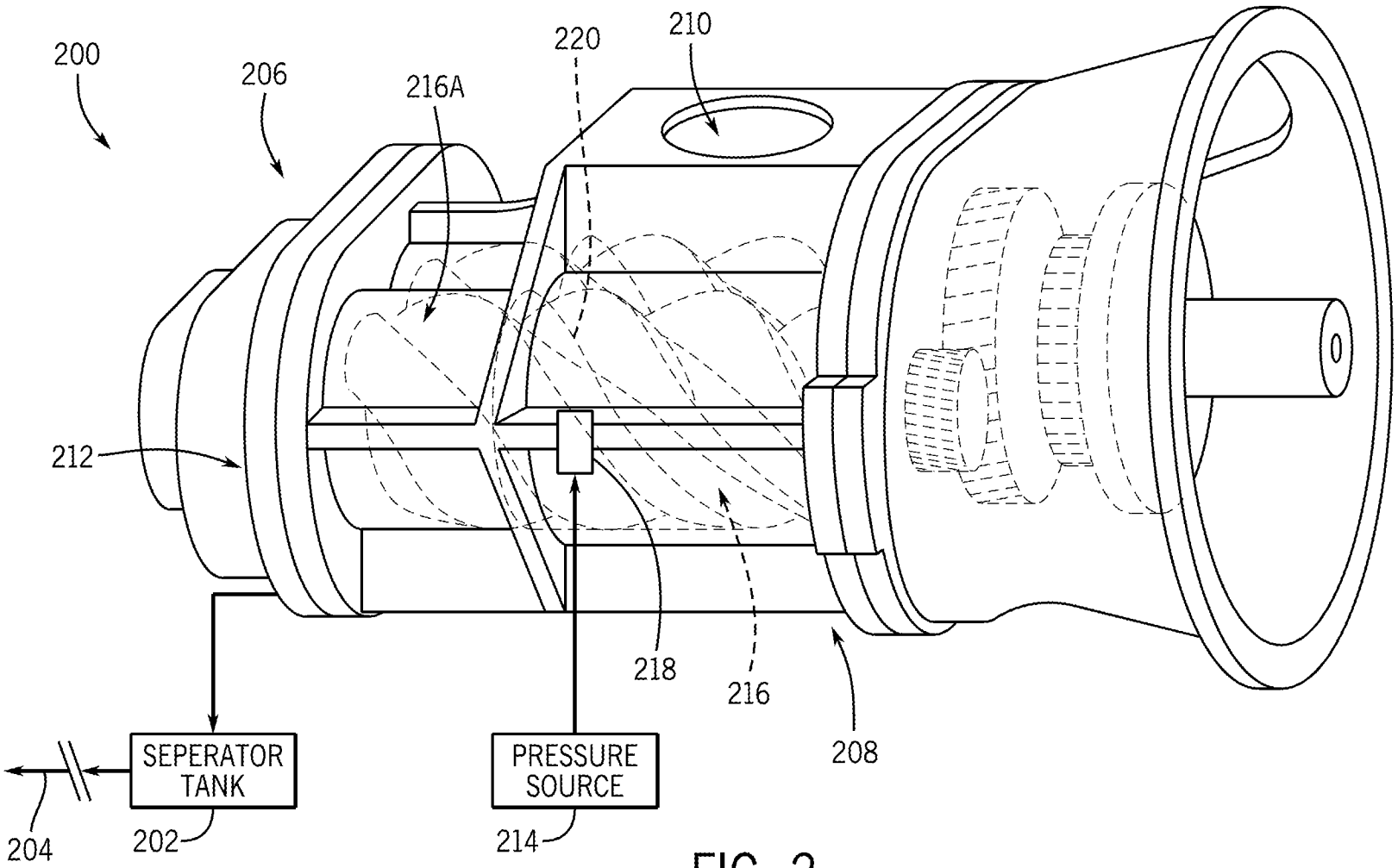
FIG. 2 is a partly schematic illustration of an air compression system with a pressure boost system according to aspects of the disclosure.

FIG. 2 illustrates select components of an air compression system 200, with a compressor 206 configured to pressurize air received through an air inlet 210 (e.g., as can be controllably opened to atmospheric pressure), to provide a pressurized air flow through a service air outlet 204. The compressor 206 includes meshed rotors (as further discussed below), and a housing structure 208 that defines the air inlet 210, an air outlet 212, and a compression chamber 216 that encloses the rotors.

Generally, the compressor 206 can be an example implementation of the compressor 120 of FIG. 1, and the compressor system 200 can be an example implementation of the system 100 of FIG. 1 (or one or more sub-systems thereof). Thus, discussion above relating to the compressor 120 and the system 100 generally relates to the compressor 206 and the system 200, respectively, unless otherwise noted.

Figure 3:
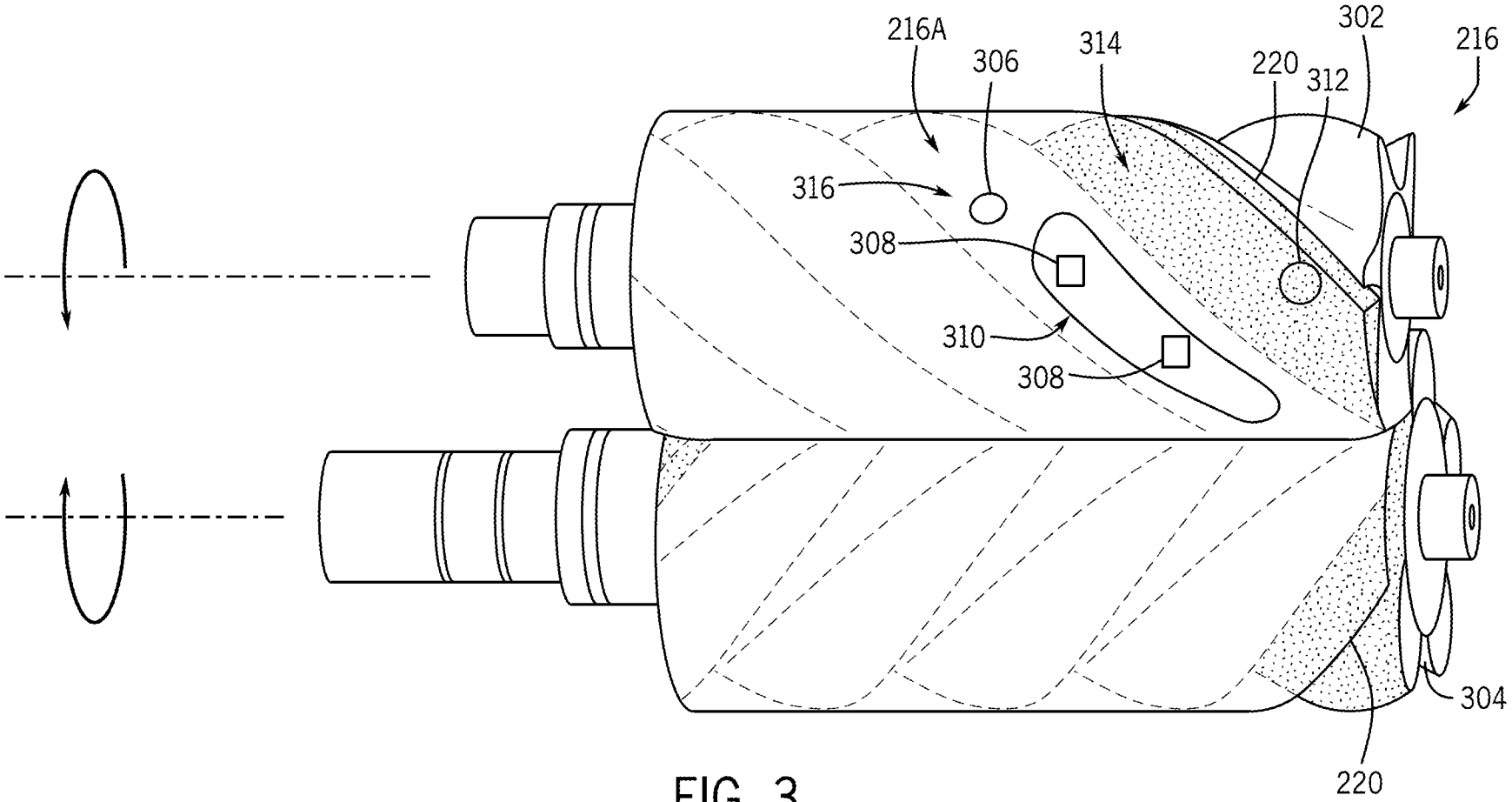
FIG. 3 is a partly schematic illustration of a first and a second rotor of the air compression system of FIG. 2, configured to form compression cells in communication with a boost port, according to aspects of the disclosure.

In particular, the compressor 206 can be configured to compress air in the compression chamber 216 using a first rotor 302 and a second rotor 304 meshed with the first rotor 302 (see FIG. 3). The compression chamber 216 can be defined by the housing structure 208 of the compressor 206 using various known structures and can include a radial cut-off 220 arranged to successively close compression cells formed by the first and second rotors 302, 304. The rotation of the first and second rotors 302, 304 then further compresses the air within the compression cells to be delivered to the air outlet 212, which is in fluid communication with the service air outlet 204 via a separator tank 202. In this regard, the radial cut-off 220 can also be considered to define a compression sub-chamber 216A within the compression chamber 216, within which the rotors 302, 304 actively compress the trapped air within closed compression cells.

To provide increased throughput without an excessive increase in power demand (e.g., engine load), the compressor system 200 can be configured to provide pressurized air into one or more closed compression cells of the compressor 206 at one or more boost ports. A boost port, for example, can be formed as an opening in a housing structure through which pressurized boost air can be introduced, or can be a more specialized port component (e.g., as can be screwed into or otherwise connected to a housing structure). As shown in FIG. 2, for example, the housing structure 208 can generally include an integrally formed boost port structure 218 in fluid communication with the compression sub-chamber 216A and with a pressure source 214. In other examples, however, other configurations are possible (e.g., with a non-integral structure, or added port fittings at a boost port, etc.).

In general, pressurized air from the pressure source 214 can be directed to flow into the compression cells downstream of the radial cut-off 220, i.e., after the compression cells have been closed. Thus, as generally shown in FIG. 2, the boost port structure 218 can be in fluid communication the compression sub-chamber 216A and can thereby be in fluid communication with one or more closed compression cells within the sub-chamber 216A. Correspondingly, the boost port structure 218 can generally provide a port (e.g., integrally formed opening) into the compression sub-chamber 216A at a location that is downstream of the radial cut-off 220, i.e., is towards higher pressure relative to pressurization of air by the rotors 302, 304. By thus providing such a secondary path (e.g., a path 316 shown in FIG. 3) for airflow into the rotors, the mass of air compressed by each compression cell—and the overall flow through the compressor 206—can be notably increased, without requiring substantial system redesign (e.g., changes to a primary inlet air path) or the inclusion of prohibitively large, expensive, or energetically costly additional components.

The pressure source 214 can be configured in a variety of ways. In some cases, the pressure source 214 can be a second compressor configured to provide pressurized air to one or more boost ports of the boost port structure 218. For example, as shown in FIG. 1, an auxiliary compressor 192 can be configured to provide pressurized air to the compressor 120 in parallel with flow through the air inlet valve 128.

In different examples, the compressor 192 (and the pressure source 214, generally) can be configured in various ways to provide additional pressurized air to a boost port. For example, as shown, the compressor 192 can be an electrically powered compressor separate from the first compressor 206, which can be powered or controlled with the controller 180 and an onboard battery (or otherwise). In some examples, the pressure source 214 can be a booster or a turbo-charger of an engine (e.g., the engine 108) arranged to power the compressor 206. In some examples, as also discussed below, the pressure source 214 can be a pressure reservoir.

As generally noted above, a boost port structure can take a variety of forms, including integrated openings in housing structures that can admit pressurized air into a closed compression cell. In some cases, a boost port structure can include multiple boost ports (e.g., to supply a larger volume of air through multiple smaller ports).

FIG. 3 illustrates select example configurations for one or more boost ports for the compressor 206. In some cases, a first boost port 306 can be formed as an opening in the housing structure 208 that is configured to provide additional air to closed compression cells of the air compressor 206, as generally discussed above. In some cases, one or more second boost ports 308 can also be provided. For example, as shown in FIG. 3, two of the boost ports 308 can be arranged to be simultaneously in communication with the same compression cell as the first boost port 306 (i.e., along an isobaric envelope 310 of the compression sub-chamber 216A). In some cases, one or more of the second boost ports 308 can instead be configured to be downstream (or upstream) of the first boost port 306 along the compression chamber 216. Thus, for example, a second boost port can be configured to provide boost air flow into compression cells that have been further pressurized by the rotors 302, 304, following a preceding injection of pressurized boost air from a first boost port (or vice versa).

During operation of the compressor 206, rotation of the rotors 302, 304 can thus move compression cells successively past the boost ports according to the geometry of the helically shaped rotors. Accordingly, the compression cells can be successively boosted with pressurized air from the pressure source 214 (see FIG. 2), for improved throughput overall and without requiring pressurization of main inlet air or other modification of main inlet structures. Further, in some cases, multiple boost ports can provide multiple secondary paths to provide air to the closed compression cells, as can further increase air pressure and flow delivered by the compressor 206, including when used in combination with multiple (or staged) low cost auxiliary air supply devices (e.g., electrical compressors, rather than turbochargers, etc.).

In some cases, one or more boost ports can be aligned to supply a compression cell immediately after the compression cell is formed (i.e., is closed by the radial cut-off 220). For example, as shown in FIG. 3, an additional (or alternative) boost port 312 can be provided adjacent to the radial cut-off 220—and upstream of the ports 306, 308—so that a compression cell 314 can be pressurized as soon as closed. Generally, however, an upstream-most boost port may be located so that a compression cell is not exposed to pressure from the boost port until the compression cell is fully closed. Thus, for example, pressurized air from the boost port may not be lost into the larger compression chamber 216 via injection of the boost air into an unclosed cell.

Figure 4B:
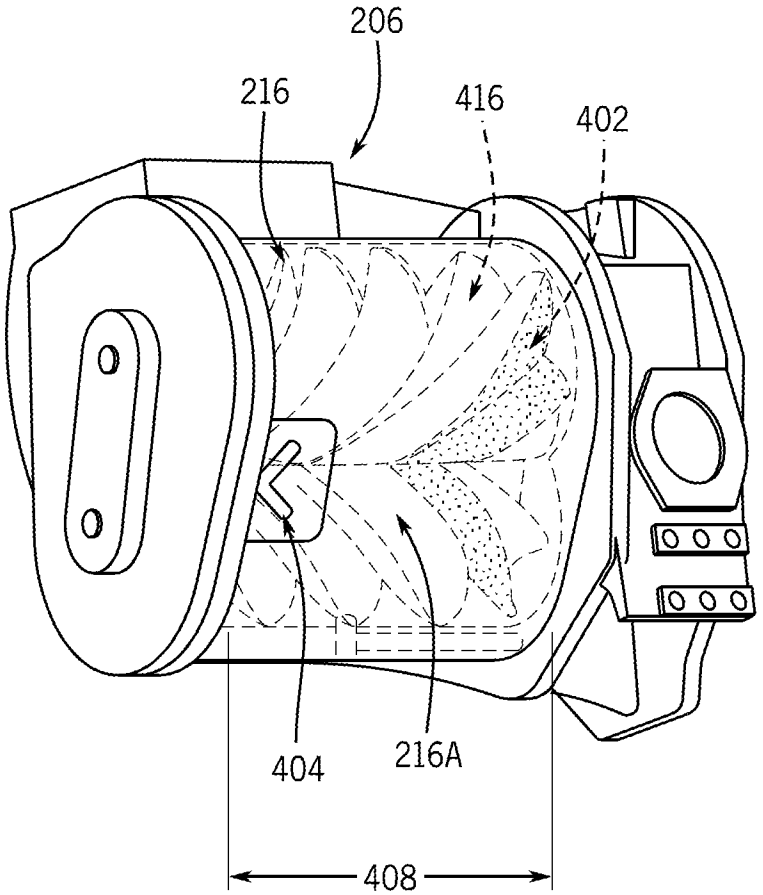
FIGS. 4A and 4B illustrate compression operations with the air compression system of FIG. 2, with a compression cell advancing from an upstream end of a compression chamber toward a downstream end of the compression chamber.
Figure 4A:
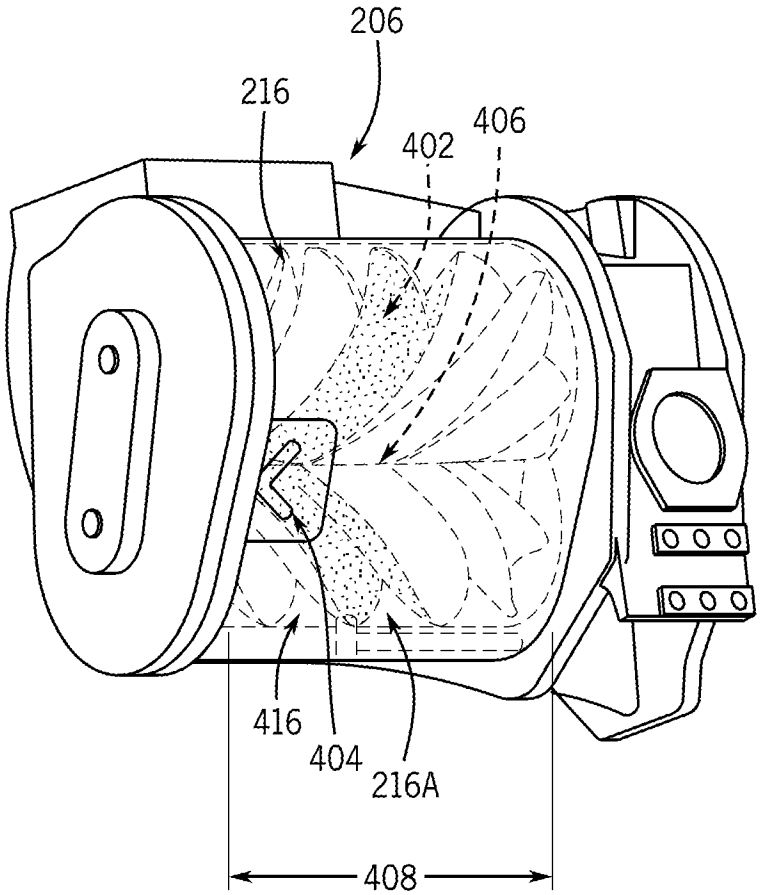

In some examples, a boost port can be an opening formed into a main housing of a compressor, including as can extend to an exterior of the housing. For example, FIGS. 4A and 4B illustrate, respectively, an example configuration of the air compression system 200 in a first stage and a second stage during operation. In the first stage, a compression cell 402 is at an upstream end of the compression chamber 216 In the second stage the compression cell 402 is at a downstream end of the compression chamber 216, due to rotation of the rotors 302, 304 (see FIGS. 2 and 3).

In the illustrated embodiment, a secondary airflow path 416 to the compressor 206 is provided through a cast (or machined) boost port 404 that is located at an upstream end of the compression chamber 216 (and the sub-chamber 216A). In other words, the boost port 404 is spaced axially from the radial cut-off 220 by less than half of a total axial length of the compression chamber 216 or sub-chamber 216A.

Directing the secondary airflow path 416 to the compressor 206 via the boost port 404 at an upstream end of the compression chamber 216 can in some examples result in a minimal expenditure of energy per unit of additional air provided through the secondary path 416. This is because pressure within each compression cell 402 is lowest just after the cell is formed, so the required pressure to inject boost air is correspondingly low. In some embodiments, the boost port 404 is spaced axially from the radial cut-off 406 by less than or equal to 20% of an axial length 408 of the compression chamber 216 (or sub-chamber 216A) between the radial cut-off 220 and the air outlet 212 (see FIG. 2).

In some cases, as also noted above, multiple (e.g., independent) boost ports can be added to a housing. Accordingly, some examples can include multiple cast or machined boost ports, including boost ports formed similarly to the port 404 shown in FIGS. 4A and 4B or located as variously illustrated and described relative to FIG. 3.

As also noted above, in some examples the pressure source 214 (see FIG. 2) can be a pressure reservoir (e.g., rather than a compressor). In some examples, an existing pressurized component of a compressor system can be used for this purpose, including pressurized components of the relevant main compressor. For example, as shown in FIG. 5, the pressure source 214 can be a gear case 504 of the air compressor 206, which can be plumbed to the boost port 404 (e.g., with suitable control components as needed, including valves, sensors, filters, etc.) as schematically represented by a dashed line in FIG. 5.

Figure 5:
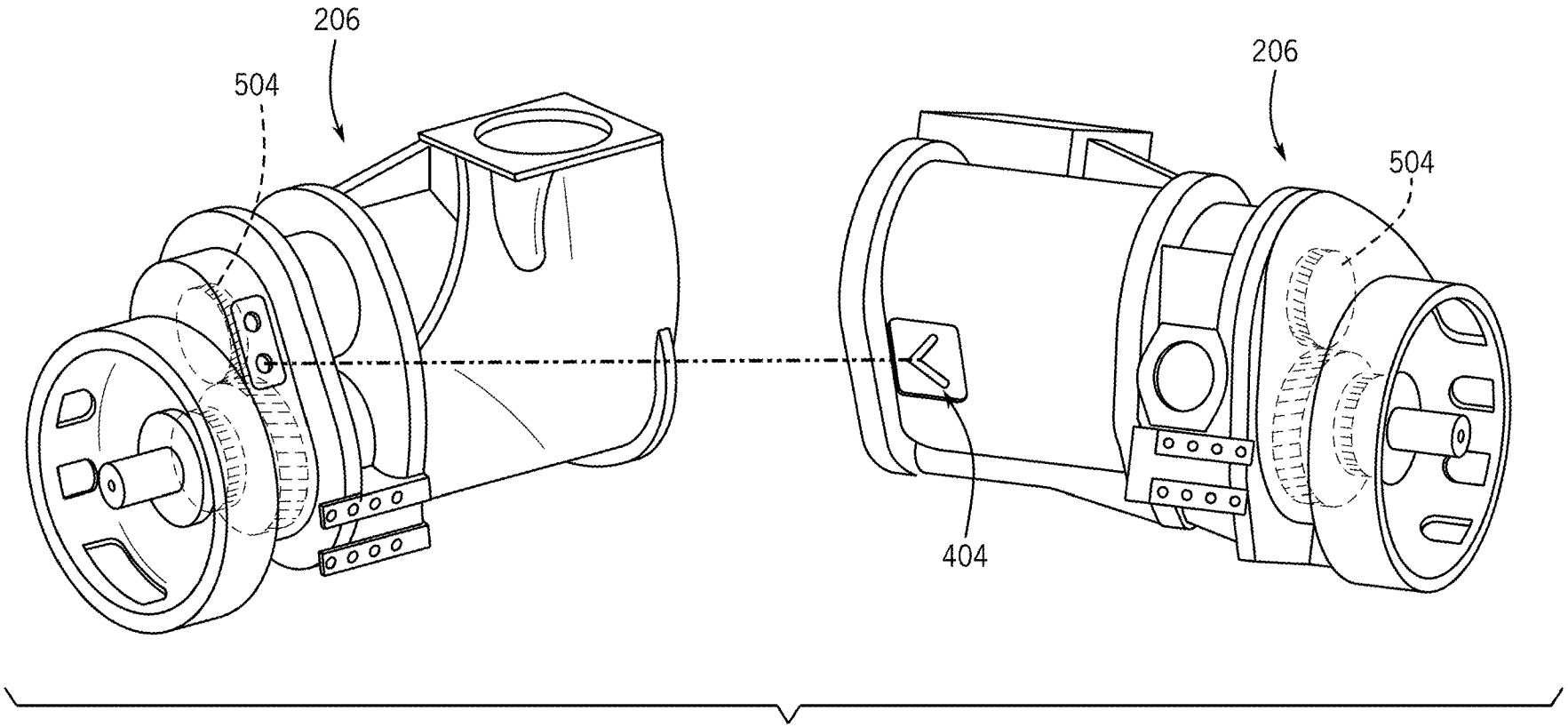
FIG. 5 is a partly schematic illustration of the air compression system of FIG. 2, with a pressure reservoir formed by a gear case of a compressor, according to aspects of the disclosure.

In some existing designs, a compressor gear case may already be pressurized, so an arrangement similar to that shown in FIG. 5 may provide a useful and simple retrofit modification for some systems. However, in other examples, other pressure reservoirs can be provided, including reservoirs that may be selectively pressurized during periods when airflow demand is low, to provide boosted flow into one or more secondary airflow paths for temporary increases in airflow and pressure to meet operator needs, as required.

Figure 6:
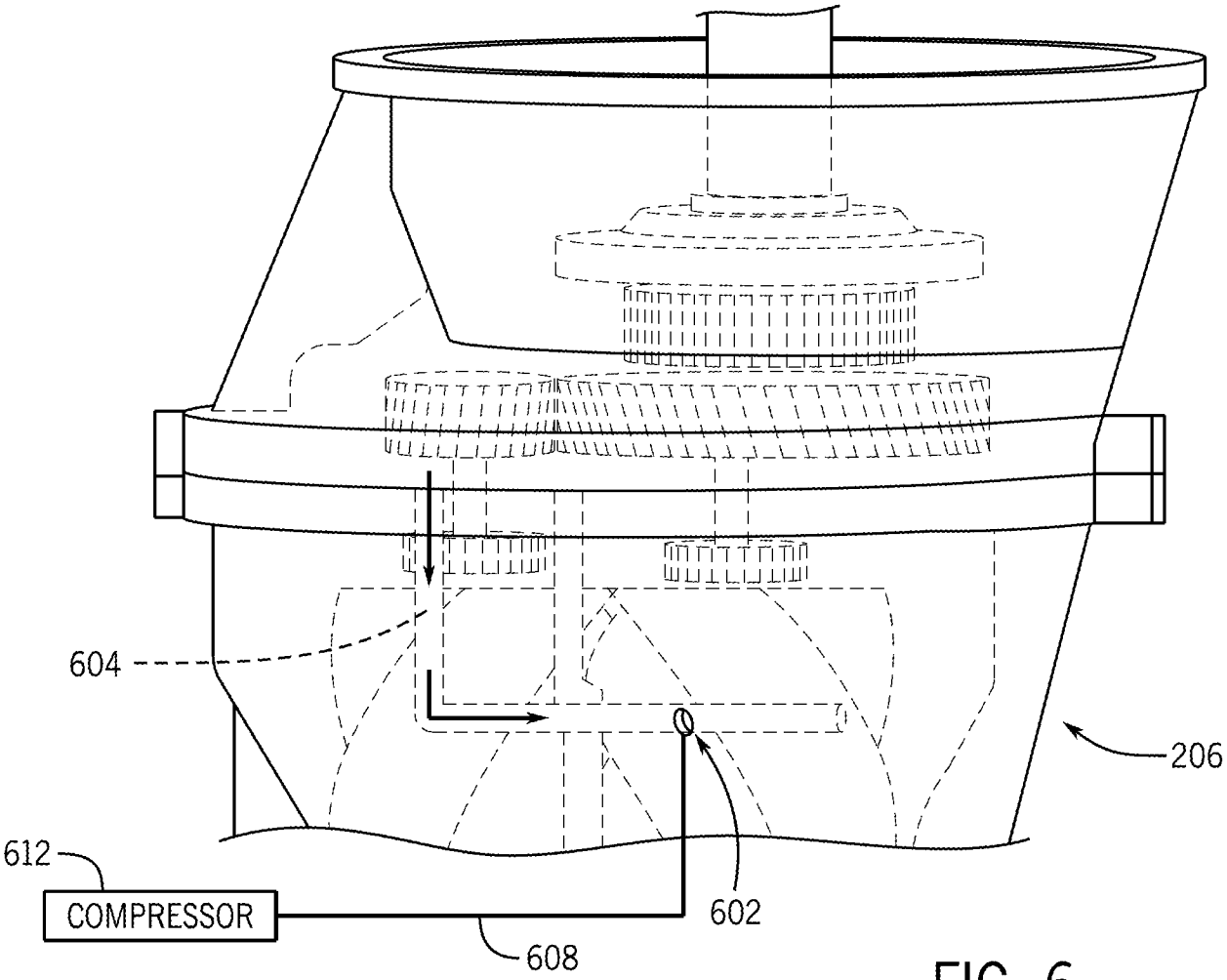
FIG. 6 is a schematic illustration of the air compression system of FIG. 3, configured with a boost port along an oil passageway, according to aspects of the disclosure.

In some embodiments, pressurized air can be provided to boost ports using pre-existing (or other) structures formed on or in a housing structure of a compression chamber (e.g., integrally formed therein). For example, FIG. 6 illustrates an oil passageway (e.g., scavenge line) 604 in communication with a gearbox or other oil-lubricated system of the compressor 206. In some cases, a boost port 602 can be provided along the oil passageway 604 (e.g., at a branched outlet therefrom) so as to provide boost air via the pressurization of the oil passageway 604.

In some embodiments, additional pressurized air can be provided to the air compression system through a boost line 608 that intersects the oil passageway 604 to assist in providing pressurized airflow through the boost port 602 (e.g., via a separate compressor 612). Because an oil scavenge line is already present in many compressor system designs, use of such a line for boost air flow may also provide a useful and simple approach for retrofitting existing systems. In other examples, however, other existing or new lines can be used.

In some implementations, devices or systems disclosed herein can be utilized, manufactured, installed, etc. using methods embodying aspects of the disclosed technology. Correspondingly, any description herein of particular features, capabilities, or intended purposes of a device or system should be considered to disclose, as examples of the disclosed technology a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, should be understood to disclose, as examples of the disclosed technology, the utilized features and implemented capabilities of such device or system.

In this regard, for example, some embodiments can include methods for operating air compression systems (e.g., the air compression system 200) to selectively (and temporarily) provide additional pressurized air to (and through) the air compressor 206. As also generally discussed above, such methods can help to ensure appropriate delivery of service air without excessive increase in load on an engine (or other power source) that powers an air compression system.

Figure 7:
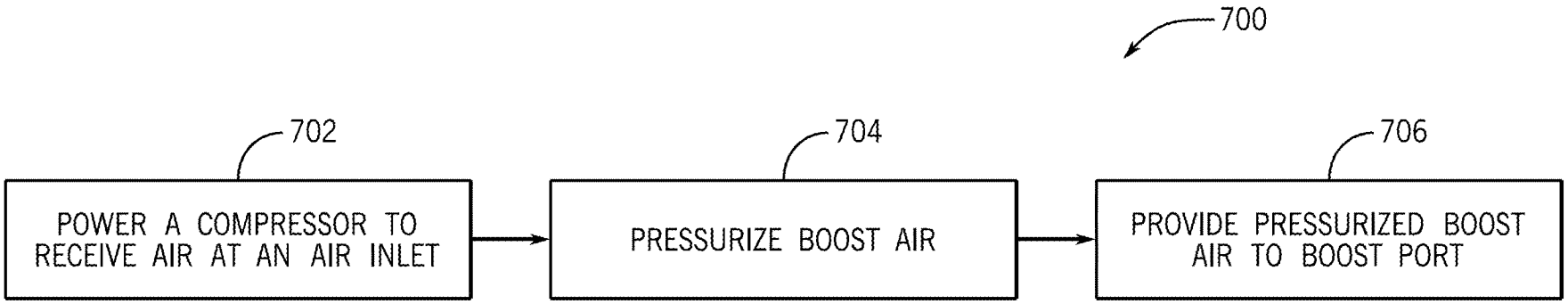
FIG. 7 is a flowchart of a method of operating an air compression system, according to aspects of the disclosure.

Referring to FIG. 7, for example, a method 700 of operating the air compression system 200 to selectively provide additional pressurized air to the air compressor 206 is illustrated. While the method 700 is described with reference to the compressor system 200 discussed above, the method 700 can also be used with other examples of the compressor system 100, as well as other types of rotating machines. In some cases, one or more operations of the method can be implemented with the controller 180 (see FIG. 1), although some examples may be similarly implemented with other generally known control devices and systems for rotating machinery and fluid flow.

As illustrated in FIG. 7, the method 700 can include, at block 702, powering a compressor 206 of the air compression system 200 to receive air at an air inlet 210 of a housing structure 208 of the compressor 206. For example, powering the compressor 206 of air compression system 200 can include powering the rotation of a first rotor 302 and a second rotor 304 meshed with the first rotor 302 to successively close and compress compression cells formed by the first and second rotors 302, 304, as discussed above. Air received from the air inlet 210 can thus be compressed and delivered to a separator tank 202 via an air outlet 212, to thereby supply compressed service air (e.g., for work operations at the service air outlet 204, as illustrated in FIG. 2).

At block 704, the method 700 can include pressurizing boost air (e.g., with or at a pressure source 214). In some embodiments, a second compressor can pressurize the boost air. In some cases, pressurizing boost air can include pressurizing a pressure reservoir (e.g., the gear case 504) using a main or auxiliary compressor. For example, the pressure source 214 can be an electrically powered compressor to pressurize boost air for delivery to a boost port in real time. As another example, a compressor for boost air flow (e.g., a second compressor) can be a booster or a turbo-charger of an engine arranged to pressurize boost air. In some examples, pressurizing boost air at block 704 can include pressurizing the boost air within a storage reservoir.

The method 700 can also include, at block 706, providing the pressurized boost air to a boost port in fluid communication with the compression chamber downstream of the radial cut-off. As generally noted above, in some embodiments, providing the pressurized boost air to a boost port can include providing the pressurized boost air from a second compressor (e.g., the compressor 192, separate from the first compressor 206). Likewise, in some embodiments, providing the pressurized boost air to a boost port can include providing the pressurized boost air from a storage reservoir.

According to some embodiments, using one or more control devices, the method 700 can further include identifying an increased demand for service air during operation of the compressor to deliver compressed air to the separator tank (e.g., to determine whether to pressurize or provide boost air, at blocks 704, 706). For example, in response to an identified increased operator demand, the air compression system 200 can operate to provide pressurized boost air from the pressure source 214 to a boost port.

Thus, in some embodiments, providing the pressurized boost air to the boost port (at block 706) can include opening a flow path for flow of pressurized boost air, or energizing a secondary compressor, based on identifying an increased demand for service air. For example, the controller 180 can be configured to monitor an output demand level of the compressor system 100, then control the compressor 192 accordingly to provide boost air as needed. Generally, such an output demand level can be a value (or values) representative of the air flow being requested from compressor system 100 by an operator, and can be measurable or derivable in various ways, including using various known approaches based on various operational parameters of the compressor system 100 (e.g., pressure, temperature, flow rate, operator use patterns, or various other sensed or derived parameters).

In some examples, additional (or alternative) components can be provided. In some cases, a check valve or other valve configured to prevent back flow (e.g., of various known types) can be arranged to prevent back flow of boost air in some cases. This may be useful, for example, when a compressor for boost air flow is provided by a turbocharger or centrifugal compressor, rather than a positive displacement compressor.

Certain operations of methods according to the invention, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the invention. Further, in some embodiments, certain operations can be executed in parallel, including by dedicated parallel processing devices, or separate computing devices configured to interoperate as part of a large system.

In some embodiments, aspects of the invention, including computerized implementations of methods according to the invention, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein.

Accordingly, for example, embodiments of the invention can be implemented as a set of instructions, tangibly embodied on a non-transitory computer-readable media, such that a processor device can implement the instructions based upon reading the instructions from the computer-readable media. Some embodiments of the invention can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re)transmits control signals and other data to and from other distributed control devices (e.g., an engine controller, an implement controller, a drive controller, etc.), including as part of a hub-and-spoke architecture or otherwise.

As used herein in the context of computer implementation, unless otherwise specified or limited, the terms "component," "system," "module," "block," "device," and the like are intended to encompass part or all of computer-related systems that include hardware, software, a combination of hardware and software, or software in execution. For example, a module may be, but is not limited to being, a processor device, a process being executed (or executable) by a processor device, an object, an executable, a thread of execution, a computer program, or a computer. By way of illustration, both an application running on a computer and the computer can be a module. One or more modules (or systems, components, and so on) may reside within a process or thread of execution, may be localized on one computer, may be distributed between two or more computers or other processor devices, or may be included within another component (or system, module, and so on).

Unless otherwise specified or limited, the terms "about" and "approximately" as used herein with respect to a reference value refer to variations from the reference value of ±5%, inclusive. Similarly, the term "substantially equal" (and the like) as used herein with respect to a reference value refers to variations from the reference value of less than ±30%, inclusive. Where specified, "substantially" can indicate in particular a variation in one numerical direction relative to a reference value. For example, "substantially less" than a reference value (and the like) indicates a value that is reduced from the reference value by 30% or more, and "substantially more" than a reference value (and the like) indicates a value that is increased from the reference value by 30% or more.

Unless otherwise specifically indicated, ordinal numbers are used herein for convenience of reference, based generally on the order in which particular components are presented in the relevant part of the disclosure. In this regard, for example, designations such as "first," "second," etc., generally indicate only the order in which a thus-labeled component is introduced for discussion and generally do not indicate or require a particular spatial, functional, temporal, or structural primacy or order.

Also as used herein, unless otherwise limited or defined, "integral" and derivatives thereof (e.g., "integrally") describe elements that are manufactured as a single piece without fasteners, adhesive, or the like to secure separate components together. For example, an element that is stamped, cast, or otherwise molded as a single-piece component from a single piece of sheet metal or other continuous single piece of material, without rivets, screws, other fasteners, or adhesive to hold separately formed pieces together, is an integral (and integrally formed) element. In contrast, an element formed from multiple pieces that are separately formed initially then later fastened together, is not an integral (or integrally formed) element.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of" For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. An air compression system comprising:

a separator tank;

a service air outlet that is in fluid communication with the separator tank to supply compressed service air for work operations;

a first compressor in fluid communication with the separator tank, the first compressor including:

a first rotor;

a second rotor meshed with the first rotor; and a housing structure that defines:

an air inlet;

an air outlet;

a compression chamber that encloses the first and second rotors, the compression chamber including a radial cut-off arranged to successively close compression cells formed by the first and second rotors, during rotation of the first and second rotors, for compression of air within the compression cells and delivery of the compressed air from the compression cells to the air outlet; and a boost port in fluid communication with the compression chamber to direct pressurized air into the compression cells downstream of the radial cut-off, the boost port being in communication with the compression chamber along an axial length of the radial cut-off; and a second compressor arranged to provide the pressurized air to the boost port.

2. The air compression system of claim 1, wherein the second compressor is an electrically powered compressor.

3. The air compression system of claim 1, wherein the second compressor is a booster or a turbo-charger of an engine that powers the first compressor.

4. The air compression system of claim 1, wherein the boost port is at an outlet for an oil passageway in communication with a gearbox of the first compressor.

5. The air compression system of claim 4, further comprising:

a boost line that intersects the oil passageway to provide the pressurized air.

6. The air compression system of claim 1, wherein the air inlet is open to atmospheric pressure.

7. The air compression system of claim 1, wherein the boost port is at an upstream end of the compression chamber.

8. The air compression system of claim 1, wherein the boost port is a first boost port and the air compression system further comprises:

a second boost port in fluid communication with the compression chamber to direct the pressurized air into the compression cells downstream of the radial cut-off.

9. The air compression system of claim 8, wherein the second boost port is arranged downstream of the first boost port along the compression chamber.

10. The air compression system of claim 1, wherein the second compressor is arranged to provide the pressurized air to the first compressor in parallel with flow through the air inlet.

11. The air compression system of claim 1, wherein the boost port is spaced axially from the radial cut-off by less than or equal to 20% of an axial length of the compression chamber.

12. A method of operating an air compression system, the method comprising:

powering a compressor to receive air at an air inlet of a housing structure of the compressor, wherein powering the compressor includes powering rotation of a first rotor and a second rotor meshed with the first rotor within a compression chamber to successively close compression cells formed by the first and second rotors, for compression of air within the compression cells and delivery of the compressed air via an air outlet of the housing structure, to supply compressed service air for work operations;

pressurizing boost air using an auxiliary compressor separate from the compressor; and providing the pressurized boost air to a boost port in fluid communication with the compression chamber downstream of a radial cut-off of the compression chamber, the boost port entering the compression chamber along an axial length of the radial cut-off.

13. The method of claim 12, further comprising:

identifying, using one or more control devices, an increased demand for service air during operation of the compressor to supply the compressed service air;

wherein providing the pressurized boost air to the boost port includes opening a flow path for flow of the pressurized boost air to the boost port in response to identifying the increased demand for the service air.

14. The method of claim 13, wherein the one or more control devices identify the increased demand for service air based on sensing one or more of a pressure, a temperature, a flow rate, or an operator use pattern of the air compression system.

15. An air compression system comprising:

an oil-flooded rotary screw compressor that includes:

a first rotor;

a second rotor meshed with the first rotor; and a housing structure that defines:

an air inlet;

an air outlet;

a compression chamber that encloses the first and second rotors, the compression chamber including a radial cut-off arranged to successively close compression cells formed by the first and second rotors, during rotation of the first and second rotors, for compression of air within the compression cells and delivery of the compressed air from the compression cells to the air outlet; and a boost port in fluid communication with the compression chamber to direct pressurized air into the compression cells downstream of the radial cut-off, the boost port being located along an axial length of the radial cut-off; and a boost compressor that provides the pressurized air to the boost port.

16. The air compression system of claim 15, wherein the boost compressor is one or more of: an electrically powered compressor, a booster of an engine arranged to power the oil-flooded rotary screw compressor, or a turbo-charger of the engine.

* * * * *